US009032893B1

(12) United States Patent
Caccamo

(10) Patent No.: US 9,032,893 B1
(45) Date of Patent: May 19, 2015

(54) ACTUATED CATCH FOR RELEASABLY SECURING A WATER VESSEL IN OPEN WATER

(71) Applicant: Matthew Caccamo, Chesapeake, VA (US)

(72) Inventor: Matthew Caccamo, Chesapeake, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 89 days.

(21) Appl. No.: 13/929,736

(22) Filed: Jun. 27, 2013

(51) Int. Cl.
*B63B 21/04* (2006.01)
*B63B 21/56* (2006.01)

(52) U.S. Cl.
CPC ..... *B63B 21/04* (2013.01); *B63B 21/56* (2013.01)

(58) Field of Classification Search
CPC ..... B63B 21/00; B63B 21/04; B63B 21/56; B63B 21/58; B63B 21/60
USPC ..... 114/230.2, 230.26, 230.3, 242, 248, 114/249, 250, 252, 253; 294/82.33, 82.27
See application file for complete search history.

(56) References Cited

U.S. PATENT DOCUMENTS

| | | | | | |
|---|---|---|---|---|---|
| 2,447,945 | A | * | 8/1948 | Knowler | 114/230.3 |
| 3,166,038 | A | | 1/1965 | Brittain | |
| 3,613,629 | A | | 10/1971 | Rhyne | |
| 4,073,255 | A | | 2/1978 | Paul | |
| 4,201,410 | A | * | 5/1980 | Crawford et al. | 294/82.33 |
| 4,516,517 | A | | 5/1985 | Ayers | |
| 4,714,288 | A | * | 12/1987 | Tietze | 294/82.33 |
| 5,123,374 | A | * | 6/1992 | McMillan | 114/230.3 |
| 5,378,851 | A | | 1/1995 | Brooke | |
| 6,662,741 | B1 | | 12/2003 | Van Der Laan | |
| 7,975,638 | B1 | | 7/2011 | Harris | |
| 8,359,993 | B1 | | 1/2013 | Harris | |

* cited by examiner

*Primary Examiner* — Lars A Olson
(74) *Attorney, Agent, or Firm* — Dave A. Ghatt

(57) ABSTRACT

A method and device to permit a water vessel to releasably capture a line in a towing station, remote from a parent ship. The towing station may be attached to the parent ship via a tow line. The line capturing device is an actuated catch that includes a hook assembly that is moveable between a release mode and a retrieval and holding mode. The actuated catch also includes a spring biased retaining catch that prevents a captured line from being inadvertently released.

13 Claims, 7 Drawing Sheets

ACTUATED CATCH FOR RELEASABLY SECURING A WATER VESSEL IN OPEN WATER

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for the releasable latching of a water vessel to a line in open water.

BACKGROUND

Larger parent ships often recover smaller surface water vessels, such as manned or unmanned surface water vessels (USN's). Once recovered by the parent ship, servicing operations on the smaller vessels may be performed. Typically, the recovery of a smaller vessel is accomplished by driving the smaller vessel alongside a stationary parent ship and lifting the smaller vessel by davit into the parent ship. Alternatively, the smaller water vessel may be driven up a ramp into the larger ship.

Traditional methods of capturing smaller surface water vessels can cause damage to the hull of the smaller vessel. For example, some USVs weigh about 20,000 pounds or more, and are made from materials such as aluminum and the like. A capturing method that for example, requires the USV to be driven into a parent ship in an uncontrolled manner can cause damage to the hull, resulting in expensive repairs and loss of operation. Similarly, smaller vessels may incur damage when driven alongside a parent ship prior to being lifted onto the ship.

The U.S. Navy has recently worked on different methods of securing water vessels in open water in locations remote from the parent ship, avoiding unnecessary damage to the water vessels. U.S. Pat. No. 7,975,638 teaches one such application in which a water vessel is captured remotely from a parent ship by dropping a line into the open water. The line may be attached at one end to a parent ship, and the water vessel drives at a relatively high speed over the line and in one or more attempts, scoops up the line into a latching mechanism. It is desired to have an arrangement that captures a water vessel, in a more controlled environment, at reduced speeds.

SUMMARY

In one aspect, the invention is a water vessel for releasably capturing a substantially taut line. The water vessel has a hull body having a bow and an actuated catch attached at the bow of a water vessel. The actuated catch is positioned for capturing the line at about the water level. The actuated catch has a pivotable hook assembly having a substantially V-shaped receiving portion for receiving the line therein. The pivotable hook assembly includes a substantially L-shaped arm including a triangular claw, and a protective shield attached to the substantially L-shaped arm at a pivot point, wherein the pivotable hook assembly is pivotable about the pivot point. The protective shield and the triangular claw are angled to form the substantially V-shaped receiving portion. In this aspect, the actuated catch also includes an actuator for pivoting the pivotable hook assembly about the pivot point, from a release position to a retrieval and holding position. The actuated catch also has a spring biased retaining catch having a holding tip for maintain the line within the receiving portion when the pivotable hook assembly is in the retrieval and holding position, and wherein the protective shield covers the holding tip when the pivotable hook assembly is in the release position.

In another aspect, the invention is a system for the open water securing and towing a water vessel. The system includes a parent ship and a towing station attached to the parent ship via a first tow line. The towing station has a first arm and a second arm, wherein the first and second arms define a substantially LT-shaped opening for receiving a water vessel in a receiving direction. The towing station also has a line attached to each of the first and second arms, so that the line is substantially taut and is substantially perpendicular to said receiving direction. In this aspect, the system also includes a water vessel for releasably capturing the substantially taut line. The water vessel has a hull body having a bow. The water vessel has an actuated catch attached at the bow of the water vessel, the actuated catch positioned for capturing the line at about the water level. The actuated catch has a pivotable hook assembly having a substantially V-shaped receiving portion for receiving the line therein. The pivotable hook assembly has a substantially L-shaped arm including a triangular claw, and a protective shield attached to the substantially L-shaped arm at a pivot point, wherein the pivotable hook assembly is pivotable about said pivot point, and wherein the protective shield and the triangular claw are angled to form the substantially V-shaped receiving portion. The actuated catch also has an actuator for pivoting the pivotable hook assembly about the pivot point, from a release position to a retrieval and holding position. Also included is a spring biased retaining catch for maintaining the line within the receiving portion when the pivotable hook assembly is in the retrieval and holding position. The protective shield covers the holding tip when the pivotable hook assembly is in the release position.

In another aspect, the invention is a method of releasably capturing a line in open water. The method includes the providing of a parent ship, the providing of a towing station connected to the parent ship via a first tow line. According to the method, the towing station has a first arm and a second arm, wherein the first and second arms define a substantially U-shaped opening for receiving a water vessel in a receiving direction. The towing station also has a line attached to each of the first and second arms, so that the line is substantially taut and is substantially perpendicular to said receiving direction. The method also includes the providing a of water vessel on the open water. The water vessel includes a hull body having a bow, and an actuated catch attached at the bow of a water vessel. The actuated catch is positioned for capturing the line at about the water level and has a pivotable hook assembly having a substantially V-shaped receiving portion for receiving the line therein. The pivotable hook assembly has a substantially L-shaped arm including a triangular claw, and a protective shield attached to the substantially L-shaped arm at a pivot point, wherein the pivotable hook assembly is pivotable about said pivot point, and wherein the protective shield and the triangular claw are angled to form the substantially V-shaped receiving portion. The actuated catch also includes an actuator for pivoting the pivotable hook assembly about the pivot point, from a release position to a retrieval and holding position, and a spring biased retaining catch having a holding tip for maintain the line within the receiving portion when the pivotable hook assembly is in the retrieval and holding position, and wherein the protective shield covers the holding tip when the pivotable hook assembly is in the release position. In this aspect, the method further includes propelling the parent ship thereby towing the towing station therebehind, and setting the hook assembly of water vessel in a retrieval mode. The method also includes driving the water vessel at a greater speed than that of the parent ship so that the water vessel enters the substantially U-shaped opening of the towing station and driving the water vessel over the substantially taut line so that said substantially taut line contacts and slides over the actuated catch onto a bow surface below the actuated catch. The method further includes throttling down the water vessel to stop or reduce the water velocity to a speed less than that of the parent ship so that the substantially taut line travels in a reverse direction with respect to the water vessel, the substantially taut line riding up the bow onto the actuated catch, wherein the substantially taut line presses down on the spring biased retaining catch and enters into the substantially V-shaped receiving portion wherein the line is held by the hook assembly and the retaining catch so that the water vessel is securely attached to the towing station and is towed behind the parent ship.

BRIEF DESCRIPTION OF THE DRAWINGS

Other features will be apparent from the description, the drawings, and the claims.

DETAILED DESCRIPTION

Figure 1:
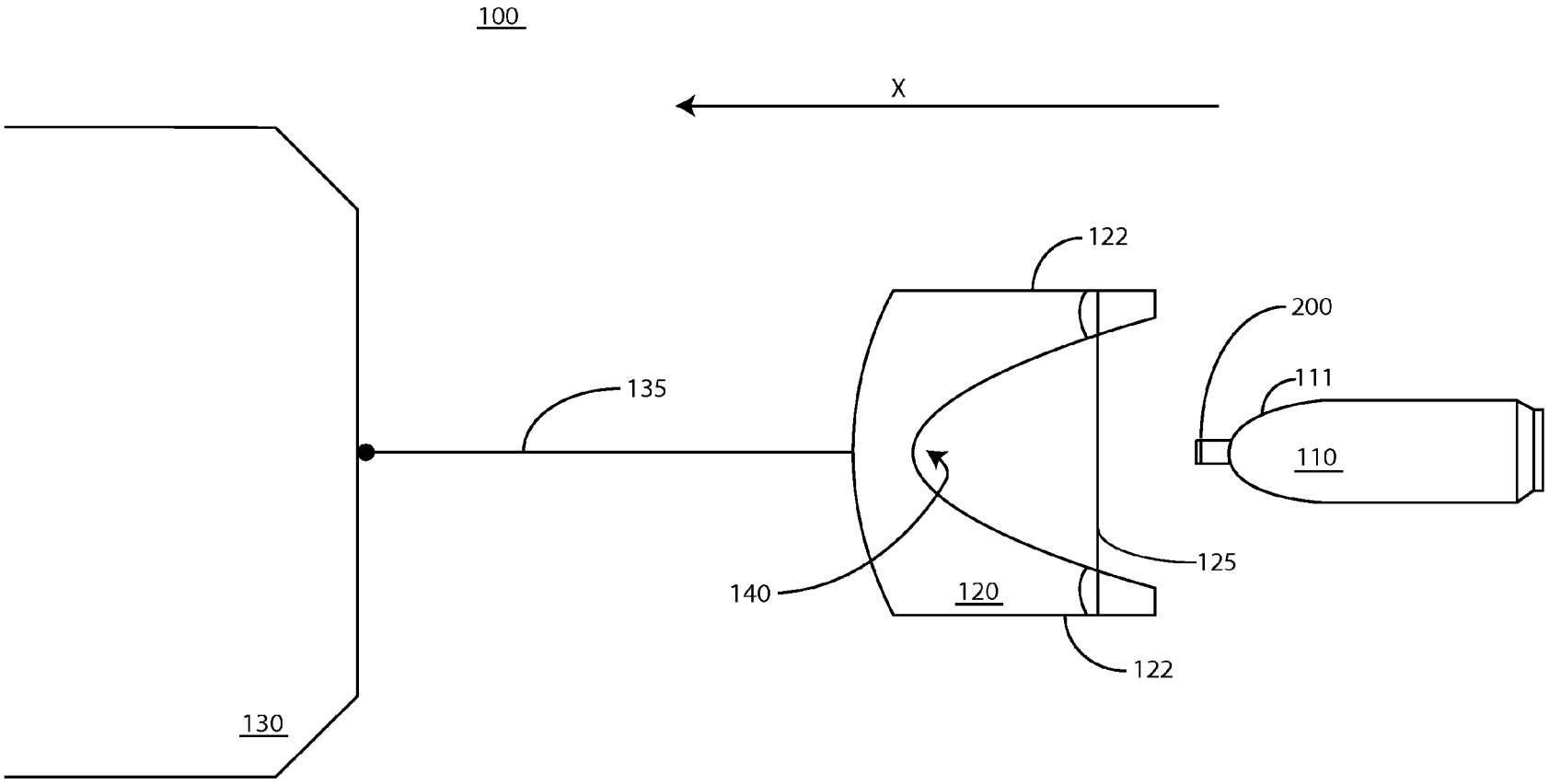
FIG. 1 is a schematic illustration of a system for the open water securing and towing a water vessel according to an embodiment of the invention.

FIG. 1 is a schematic illustration of a system 100 for the open water securing and towing a water vessel 110 according to an embodiment of the invention. The water vessel 110 may be a manned or unmanned surface vessel, and depending on the application, the water vessel 110 may have a length of about 15 ft. to about 50 ft. The system 100 also includes a towing station 120 for securing and towing a water vessel 110. In addition to towing the water vessel 110, the towing station 120 may also be used to perform servicing operations such as recharging energy supplies, supplying fuel, and providing for the electronic exchange of data, such as mission date etc. As shown in FIG. 1, the system 100 also includes a parent ship 130, which is typically a larger water vessel, such as a sea base which transports smaller vessels such as water vessels 110 and the like. The towing station 120 may be attached to the parent ship 130 via a tow line 135. As outlined below, in operation, the parent ship 130 pulls the towing station 120 via the tow line 135, and the water vessel 110 attaches itself to the towing station 120, so that the water vessel 110 is also towed by the parent ship 130.

FIG. 1 schematically shows the surface water vessel 110 having a bow 111 and an actuated catch 200 attached at the bow 111 of the water vessel 110. As will be outlined below, the actuated catch 200 is used to secure the water vessel 110 to the towing station 120. As shown the towing station has first and second arms 122 that are flared so that together they define a substantially U-shaped opening 140 for receiving a water vessel 110, which would typically enter into the substantially U-shaped opening in a receiving direction X. FIG. 1 also shows a line 125 which is secured to the first and second arms 122 in a taut manner, so that the line 125 stretches across the substantially U-shaped opening 140 in a direction that is substantially perpendicular to the receiving direction X. The line 125 is secured to the arms 122 so that the line is at about the level of the water. The line 125 may be a rope, a cable, or the like, and may be made from any desired material, such as nylon for example. The towing station 120 including the arms 122, may be made from a combination of metallic materials and buoyant materials. According to an embodiment, the towing station is metal reinforced inflated structure, and made from a material such as natural rubber, urethane rubber, fluororubber, silicone rubber, elastomers, plastics, and the like, and combinations thereof.

Figures 2A, 2C:
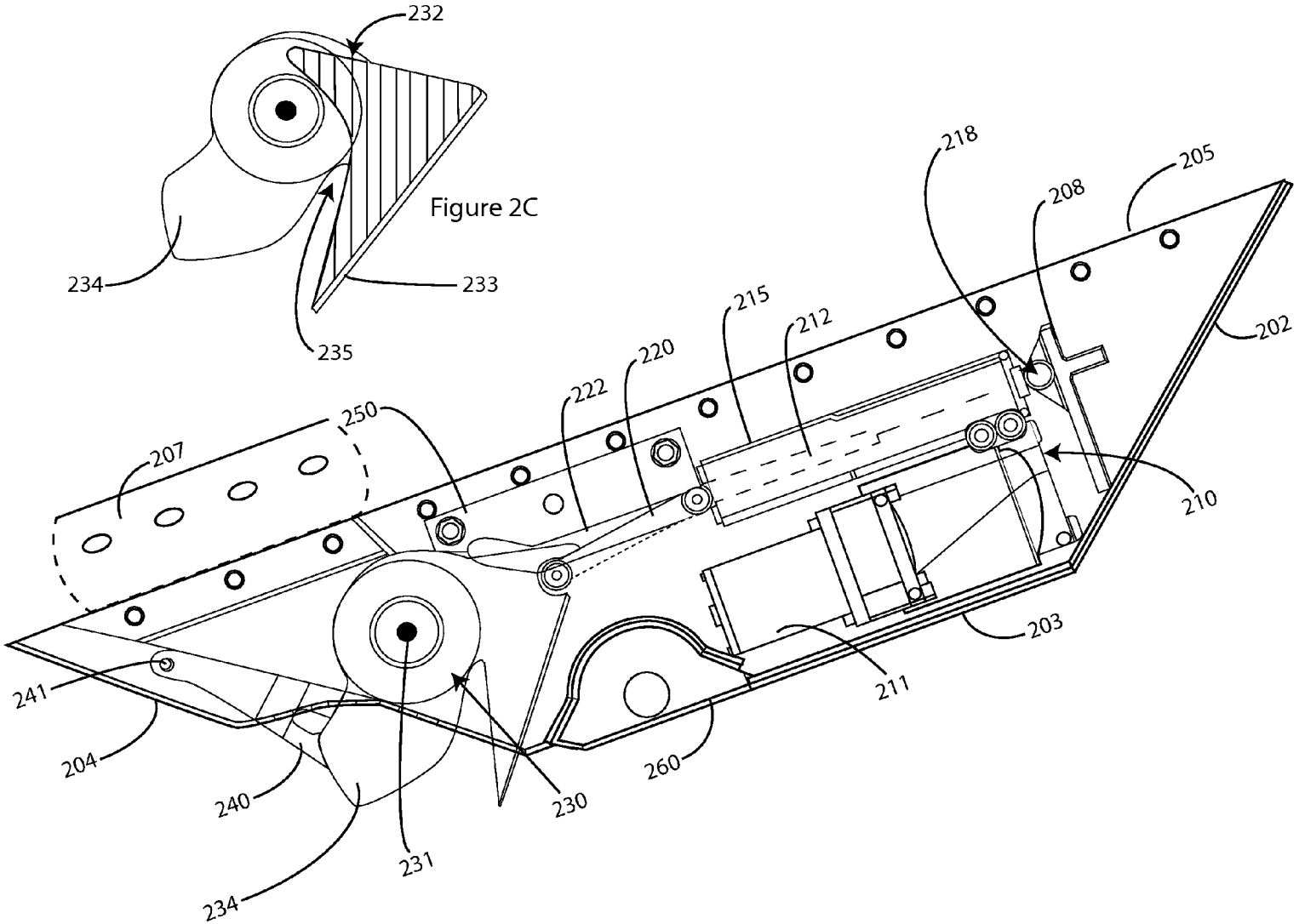
FIG. 2A is an exemplary side view of the actuated catch in a release mode, according to embodiments of the invention.
FIG. 2C is an exemplary illustration of the hook assembly, according to an embodiment of the invention.

As stated above, in operation, the parent ship 130 pulls the towing station 120 via the tow line 135, and the water vessel 110 attaches itself to the towing station 120, so that the water vessel 110 is also towed by the parent ship 130. The key to this arrangement is the ability of the water vessel 110 to attach itself to the towing station 120. As shown schematically in FIG. 1, the water vessel 110 includes an actuated catch 200. The actuated catch 200 captures the line 125 therein, securely fastening the water vessel 110 to the towing station 120. FIGS. 2A and 213 as described below, outline the different features of the actuated catch 200 in two different modes of operation: release mode; and retrieval and holding mode.

FIG. 2A is an exemplary side view of the actuated catch 200 in a release mode, according to an embodiment of the invention. FIG. 2A shows a substantially trapezoidal side plate 201 which forms part of the casing that houses the device. As shown, the plate 201 a top edge portion 202, a middle edge portion 203, a bottom edge portion 204, and a back edge portion 205, which contacts the bow 111 of the water vessel 110. FIG. 2A also shows a bow eye 207 (in dotted lines) on the hull of the water vessel, which is used to secure the actuated catch 200 to the bow 111 of the water vessel 110. The known attachment means such as screws, bolts, welds, and the like may be used to attach the catch 200 to the water vessel 110. As shown, the actuated catch 200 includes a secondary bow eye 260 at the middle edge region 203 of the casing.

The side view of FIG. 2A also shows the internal elements of the actuated catch 200. For illustration purposes only, the plate 201 has been presented as transparent. As shown the device includes an actuator 210, which includes an electrical motor 211. As shown, the actuator 210 is a pneumatic actuator or the like, having an arm 212 that extends and retracts from a cylinder 215. The actuator 201 is pivotally attached at pivot point 18 to a chassis support 208 within the casing of the actuated catch 200. As outlined below, the actuator 210 may pivot about the pivot point 218 to accommodate for the extension of the 212.

The arm 212 of the actuator 210 is attached to a link 220. As shown, the other end of the link 220 is attached to a hook assembly 230. The hook assembly 230 is pivotally mounted about a pivot point 231. As outlined below, when initiated, the actuator arm 212 extends into a channel 222, pushing the link 220, which in turn pushes and pivots the hook assembly 230 about the pivot point 231. FIG. 2A also shows a cam lock device 250.

FIG. 2C is an exemplary illustration of the hook assembly 220, according to an embodiment of the invention. As shown, the hook assembly 230 includes a substantially L-shaped arm 232 and protective shield arm 234. The substantially L-shaped arm 232 and the protective shield arm 234 are connected at about the pivot point 231 at which the hook assembly 230 is pivotally mounted. As shown, the substantially L-shaped arm 232 and the protective shield arm 234 define a substantially V-shaped receiving portion 235 for receiving a line therewithin. FIG. 2C also shows the substantially U-shaped arm 232 having a triangular claw 233.

Returning to FIG. 2A, as shown, the actuated catch 200 also includes a spring biased retaining catch 240, pivotally mounted at pivot point 241. The retaining catch 240 is biased so that when pushed inwards in direction shown by arrow 244, the retaining catch 240 moves in and pivots about the pivot point 241. When the force on the spring is released, the catch 240 returns to the original position. (This process is outlined below with respect to FIGS. 3A and 3B.) As outlined below with respect to FIG. 2B, in operation, the retaining catch 240 and the triangular claw 233 help maintain the line 125 within the substantially V-shaped receiving portion 235.

As stated above, the illustration in FIG. 2A represents the actuated catch 200 in a release mode. In release mode, the actuated catch 200 is in the position shown with the hook assembly 230 is in a release position. In this release position, both the triangular claw 233 and the protective shield arm 234 extending beyond the middle and bottom edge portions 203 and 204 of the plate 201. Thus, if the hook assembly 230 had been holding a line within the substantially V-shaped portion 235, that line would be free to slide out of the hook. It should be noted that the retaining catch 240 is biased so that its default position also extends beyond the bottom edge portion 204 of the plate 201. However, in the release position, the protective shield arm 234 covers and protects the edge/holding tip 242 (see FIG. 2B) of the retaining catch 240, thereby preventing any debris from being caught in the device. It should be noted that because the protective shield arm 234 covers the holding tip 242, the holding tip 242 is not visible in the illustration of FIG. 2A, however the holding tip 242 can be seen in FIG. 2B.

Figure 2B:
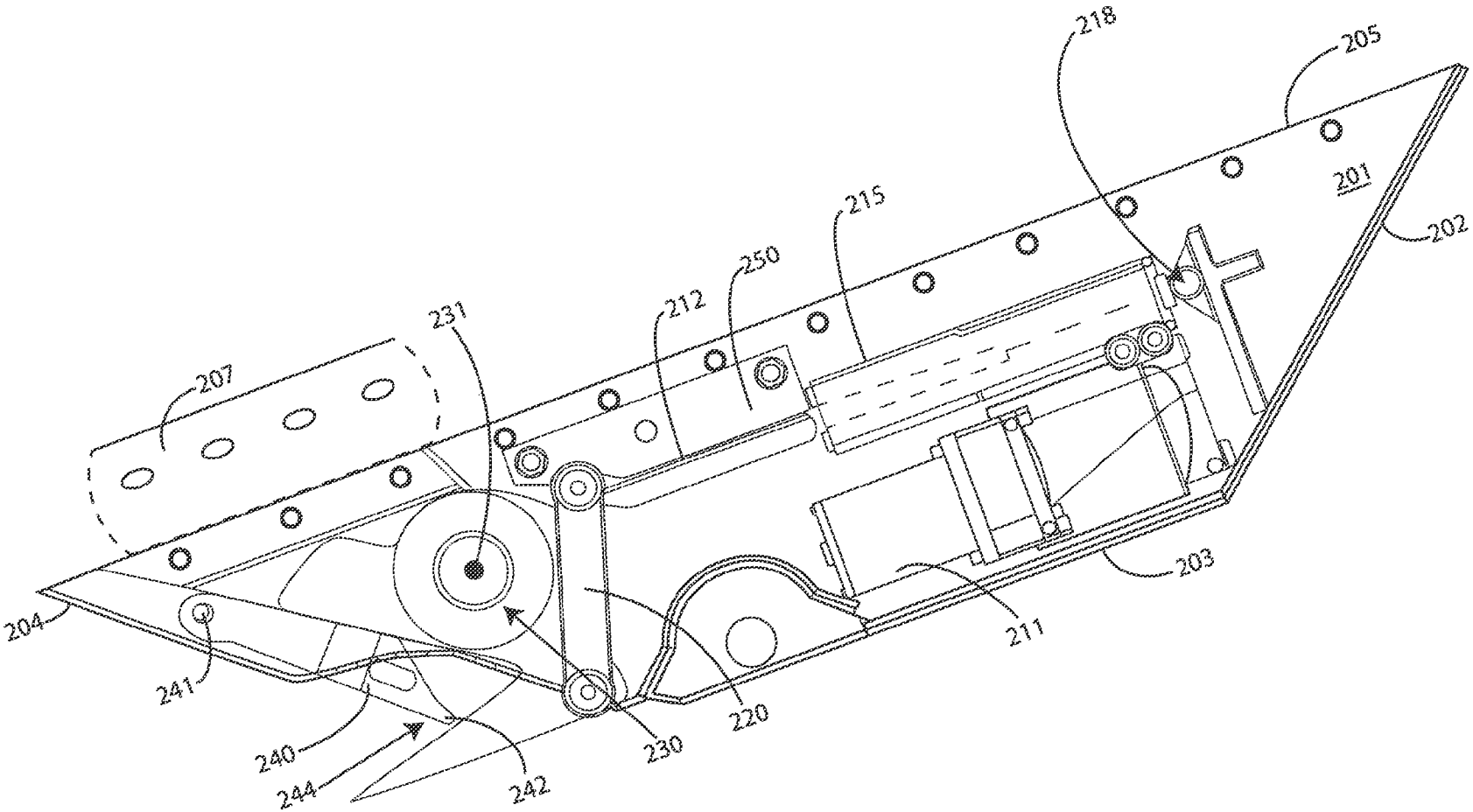
FIG. 2B is an exemplary side view of the actuated catch in retrieval and holding mode, according to embodiments of the invention.

FIG. 2B is an exemplary side view of the actuated catch 200 in retrieval and holding mode, according to an embodiment of the invention. It should be noted that the elements illustrated in FIG. 2B have already been outlined in the description of FIG. 2A. Consequently, the elements in FIGS. 2A and 2B are identically numbered. However, FIG. 2B is an illustration of the actuated catch 200 in the retrieval and holding mode, as opposed to the release mode of FIG. 2A. Thus, FIG. 2B shows the actuated catch 200 with the elements positioned to retrieve and hold a line within the device. In particular, the hook assembly 230 shown in FIG. 2B is pivoted clockwise, with respect to its position in FIG. 2A into retrieval and holding position. This is achieved when the actuator arm 212 extends down the channel 222, pushing the link 220 downwards, which in turn rotates the hook assembly 230 in the clockwise direction as shown. In this position, the protective shield arm 234 rotates upwards to a position substantially within the casing, and the triangular claw 233 rotates so that the claw 233 and holding tip 242 of the retaining catch 240 oppose each other so that when a line is captured within the substantially V-shaped receiving portion 235, the retaining catch 240 prevents the line from sliding down past the triangular claw 233, thereby maintaining the line within the substantially V-shaped receiving portion 235. Also shown in FIG. 2B is the cam lock 250, which locks the link 220 in position, so that the hook assembly 230 is maintained in the retrieval and holding position by the cam lock 250, eliminating unnecessary strain on the electric motor 211.

Figures 2D, 2E:
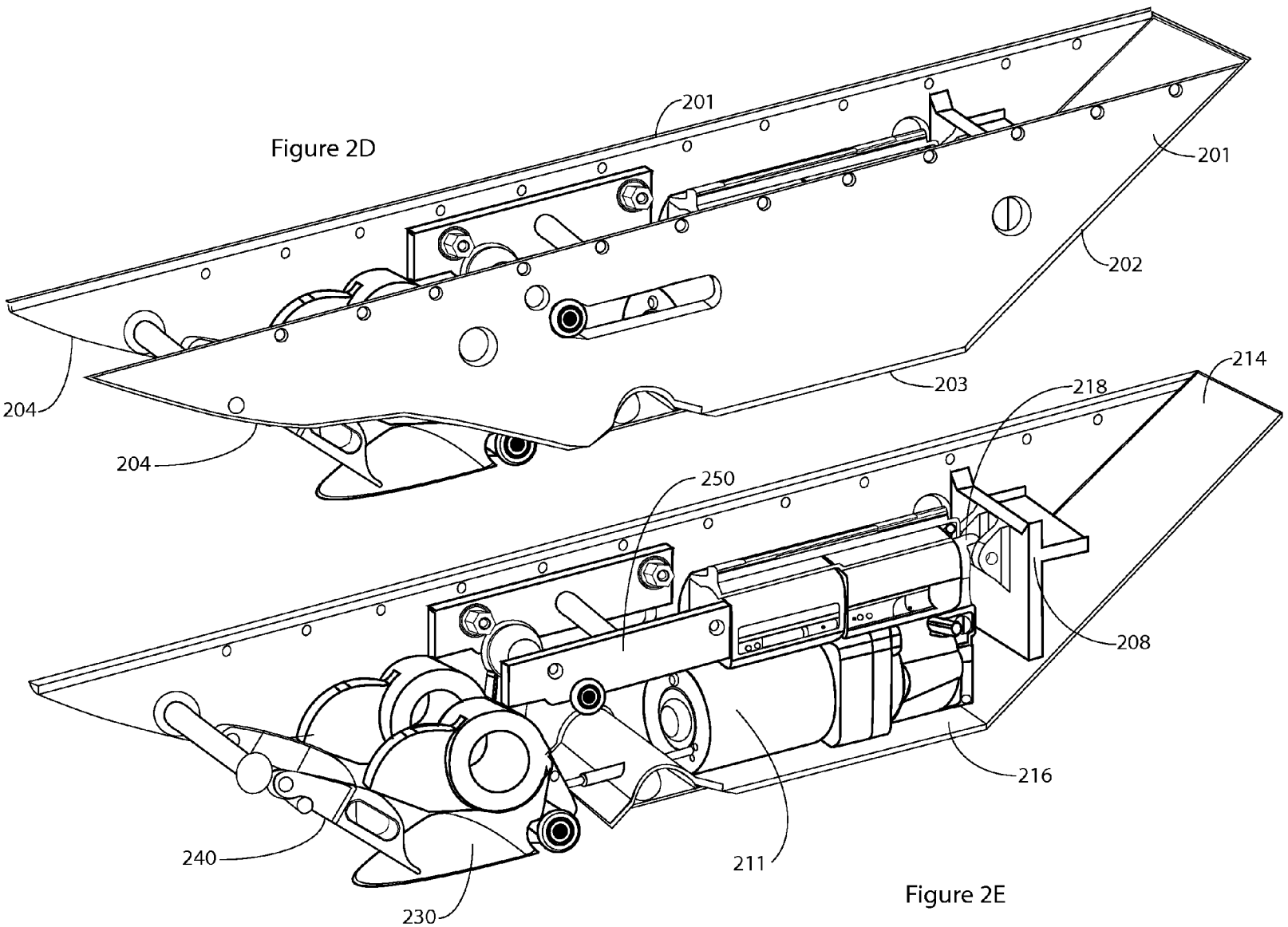
FIG. 2D is an exemplary perspective illustration of the actuated catch, according to an embodiment of the invention.
FIG. 2E is an exemplary perspective illustration of the actuated catch, with one plate removed, according to an embodiment of the invention.

FIGS. 2D and 2E are exemplary perspective illustrations of the actuated catch 200, according to an embodiment of the invention. FIG. 2D provides perspective regarding the casing of the actuated catch 200, showing the device having two substantially trapezoidal plates 201. FIG. 2E provides perspective with one of the plates removed, showing the casing and inner elements of the catch 200 including mounting elements not clearly visible from the side views of FIGS. 2A and 2*a* For example, FIG. 2E shows rectangular plates 214 and 216 for housing the elements of the actuated catch 200. FIG. 2E also shows chassis support 208 upon which the actuator 210 is pivotally mounted. It should be noted that the elements illustrated in FIGS. 2D and 2E have already been outlined in the description of FIGS. 2A-2C. Consequently, the elements in FIGS. 2A-2C and those of FIGS. 2D-2E, are identically numbered.

Figure 3A:
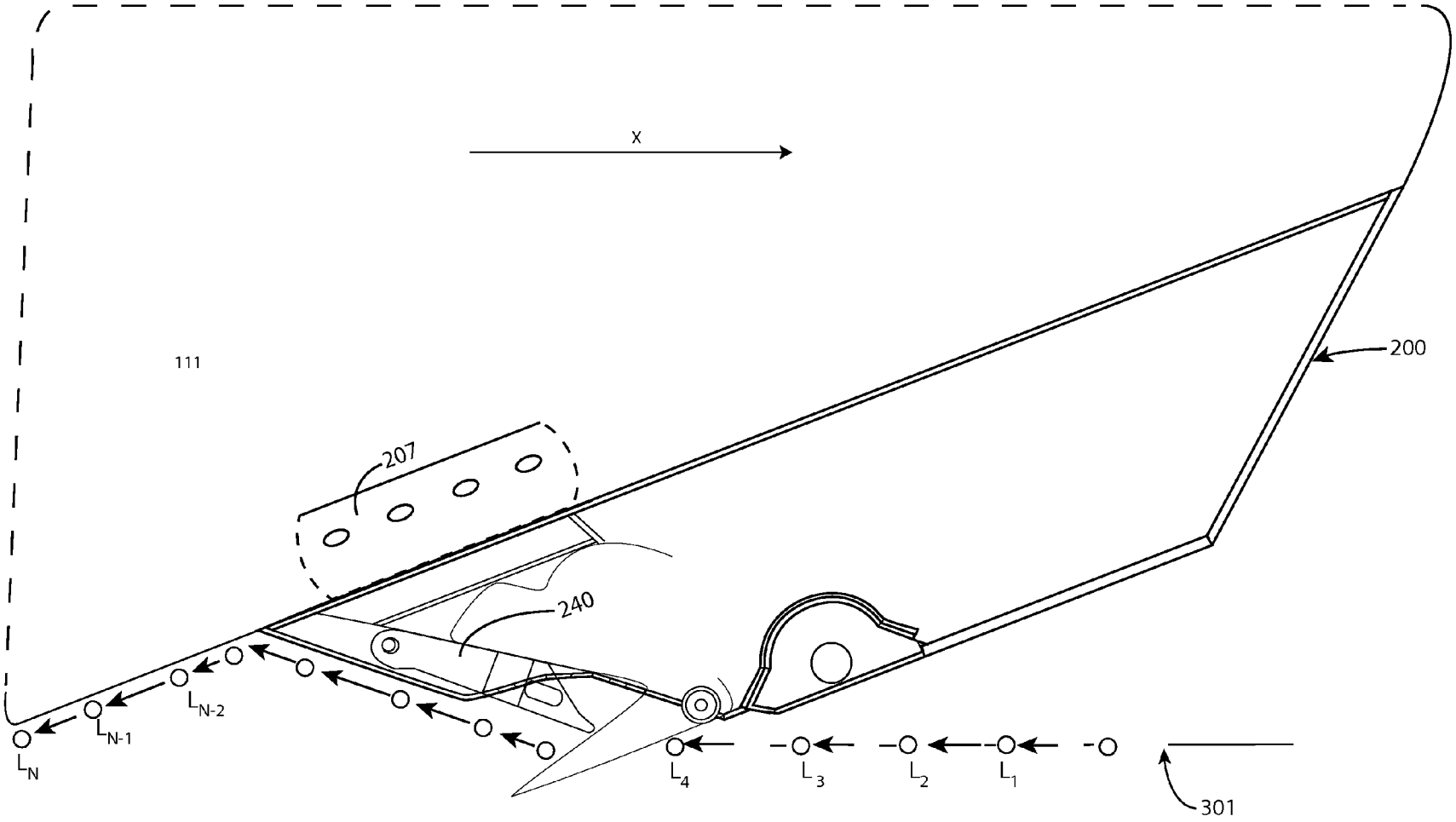
FIG. 3A is an exemplary explanatory illustration, tracking the path of the line during showing the process involved in capturing the line, according to an embodiment of the invention.
Figure 3B:
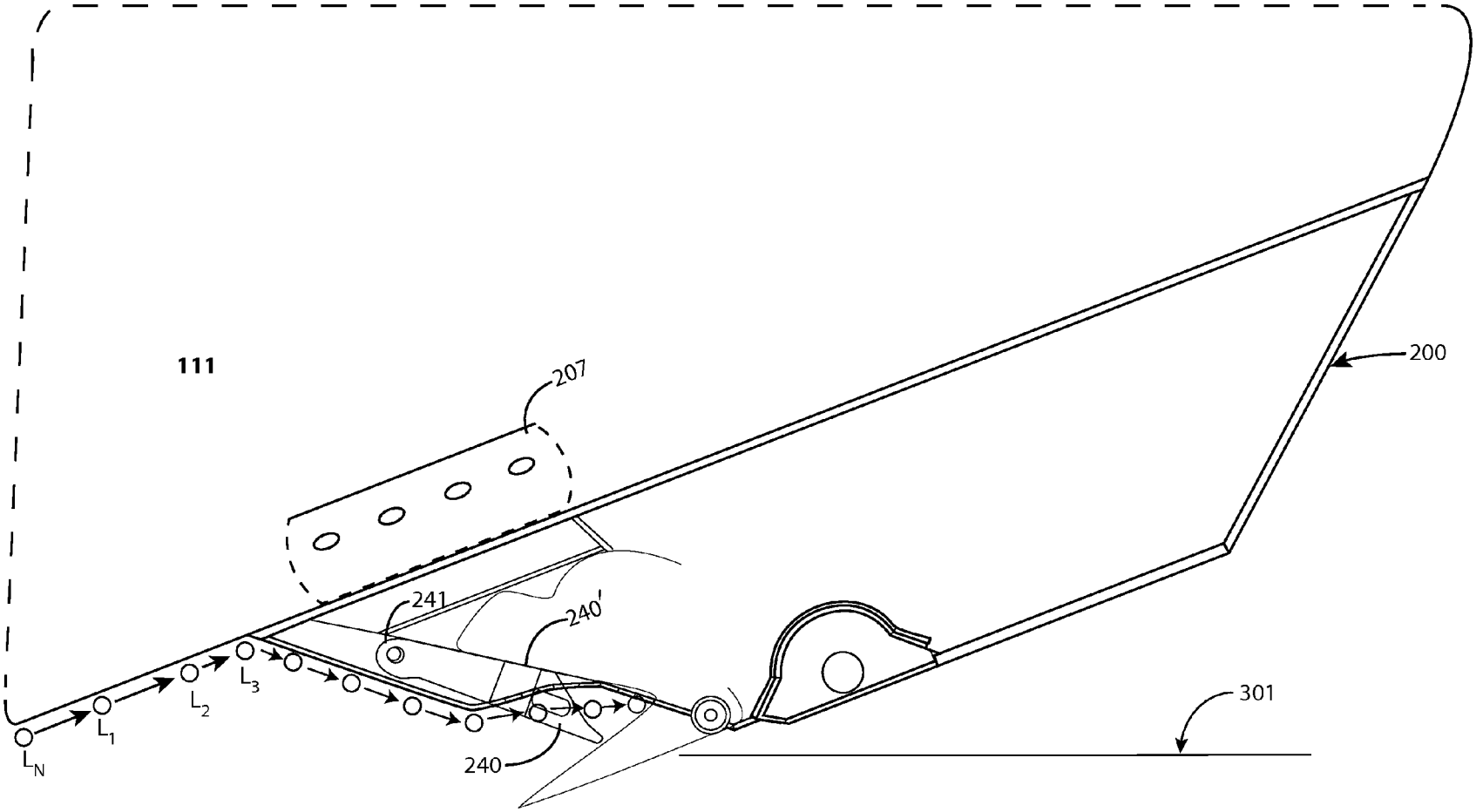
FIG. 3B is an exemplary explanatory illustration, showing the process involved in capturing the line, according to an embodiment of the invention.

FIGS. 3A and 3B are exemplary explanatory illustrations of a cut-out portion of the bow 111, showing the process involved in capturing the line 125 within the actuated catch 200, according to an embodiment of the invention. As outlined above the line 125 may be a rope, a cable, or the like, and may be made from any desired material, such as nylon for example. In operation, as shown in FIG. 1, the parent ship 130 is travelling in direction X, pulling the towing station 120 behind it. The parent ship 130 may travel at a speed of about 3 to about 6 knots, but slower than the boat being retrieved. The actual speed depends on sea conditions because the water vessel 110 being retrieved may have difficulty holding a steady heading. The water vessel 110 approaches the towing station 120 at a speed of about 3 to about 6 knots, but faster than the parent ship 130. Because the water vessel 110 travels faster than the parent ship 130, the water vessel 110 advances faster than the towing station 120 and therefore enters the substantially U-shaped opening 140 of the towing station 120. Because the goal is to capture the line within the actuated catch 200, the catch 200 is set in the retrieval and holding mode shown above in FIG. 2B, as opposed to the release mode of FIG. 2A. Upon entering into the substantially U-shaped opening 140, the water vessel crosses over the line 125 with the line making contact with the actuated catch 200 and the bow 111 of the water vessel. After crossing the line 125, the water vessel 110 throttles down, which as outlined below, allowing the line 125 to be captured into the receiving portion 235 of the actuated catch 200. FIG. 3A tracks the path of the line 125 over the actuated catch 200 and the bow 111 when the water vessel 110 is driven forward in direction X. FIG. 3B tracks the path of the line 125 after the water vessel 110 has throttled down, showing how the line 125 is eventually captured by the actuated catch 200.

As stated above, FIG. 3A tracks the path of the line 125 over the actuated catch 200 and the bow 111 when the water vessel 110 is driven forward in direction X. FIG. 3A shows the line 125 in a first position $L_1$ with respect to the water vessel 110, then subsequent positions, $L_2$ and $L_3$ etc. as the water vessel is moves forward in direction X. As shown, the first four positions shown, i.e., $L_1$ to $L_4$ represent positions along the waterline 301. FIG. 3A shows the line 125 making initial contact with the actuated catch 200 at the middle edge portion 203 at $L_4$. As the water vessel 110 continues to move forward, the line 125 slides down the middle edge portion 103 onto the bottom edge portion 104, and finally onto the bow 111 of the water vessel. The middle edge portion 103, the bottom edge portion 104, and the bow 111 are angled to allow for a smooth transition of the line 125 as it moves from the location of the initial contact $L_1$ to the position $L_N$, which according to this particular embodiment, is the location where the line 125 progresses farthest down the bow 111. The line 125 stops at $L_N$ because after initial contact with the line 125, the water vessel is throttled down to stop or reduce the rate of forward movement. Consequently, because of the towing station 120 (to which the line is attached at both ends) is being pulled by the parent ship 130, the towing station 120 advances faster than the water vessel 110, so after reaching location $L_N$ the line 125 is pulled in the opposite direction with respect to the water vessel 110, FIG. 3B tracks the path of the line 125 in the opposite direction after the water vessel 110 has throttled down, showing how the line 125 is eventually captured by the actuated catch 200. As shout in FIG. 3B, after staring at the leftmost position $L_N$, the line 125 moves to positions $l_1$, $l_2$ $l_3$, and finally to $l_n$ where the line is fully secured within the hook assembly. The positions shown in FIG. 3B track the line 125 as it moves back up the bow 111 of the water vessel 110 to the bottom edge portion 104 of the actuated catch 100. As shown, at position $l_3$ the line 125 initially contacts the bottom edge portion 104. The line then moves up until it contacts the spring biased retaining catch 240. The load associated with this contact suppresses the retaining catch 240 which pivots inwards about pivot point 241 (as shown by the dotted lines 240) and the suppressed surface guides the line 125 into the substantially V-shaped receiving portion 235 of the hook assembly 230. Once fully within the receiving portion 235 after sliding off the retaining catch 240, the retaining catch moves back to its original position where it opposes the triangular claw 233 of the hook assembly 230, thereby preventing the line 125 from sliding out of the actuated catch 200. As stated above, the line may be a rope, a cable, or the like, and may be made from any desired material, such as nylon for example. The retaining catch 240 and other elements of the device 200, as well as the bow 111, may be made from a metallic material such as aluminum that allows the line 125 to easily slide thereon.

Figure 4:
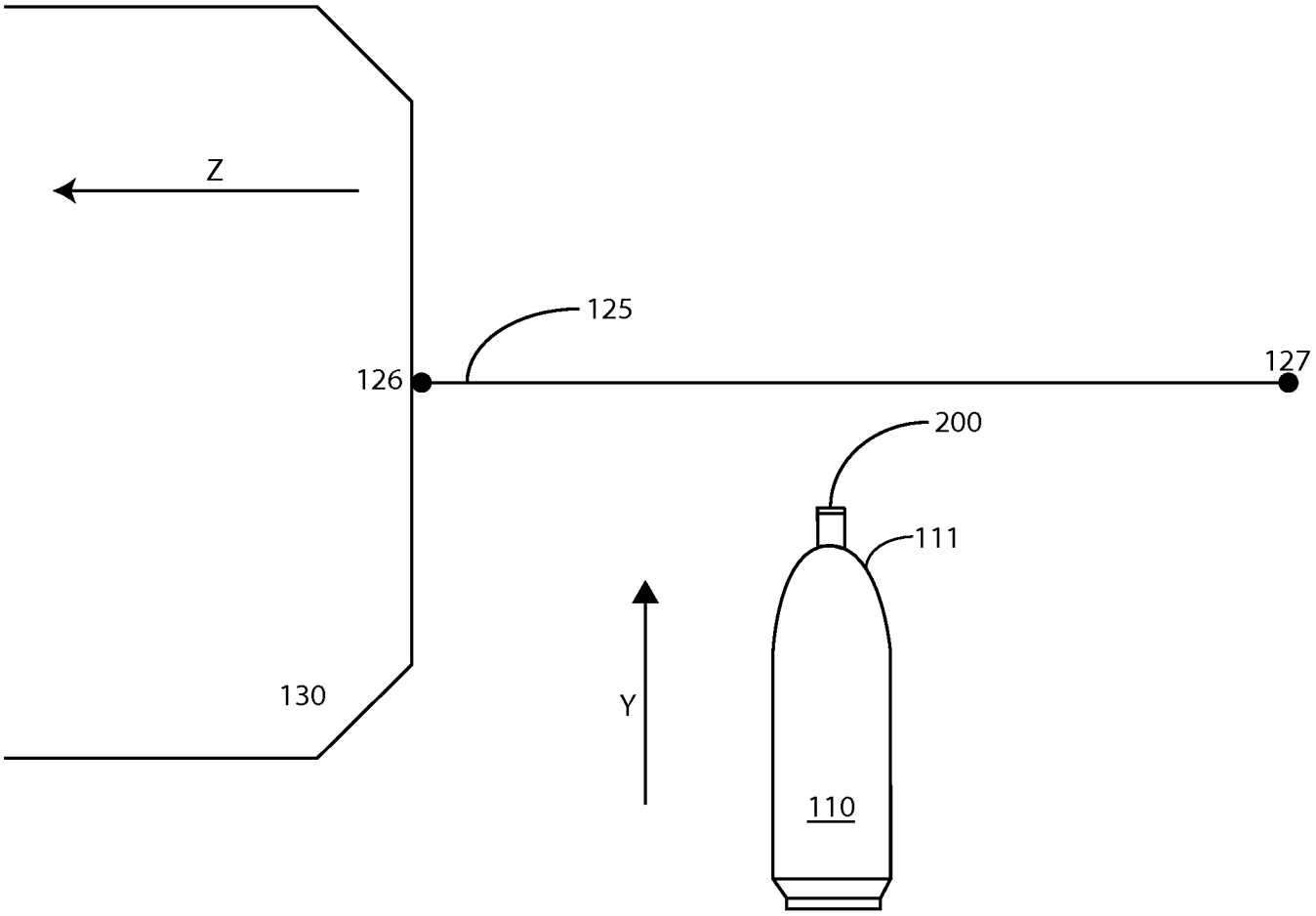
FIG. 4 is a schematic illustration of a system for the open water securing of a water vessel, according to an embodiment of the invention.

FIG. 4 is a schematic illustration of a system 400 for the open water securing and towing a water vessel 110 according to an embodiment of the invention, As outlined above, the water vessel 110 may be a manned or unmanned surface vessel. The system 400 includes a parent ship 130, and a line 125 extending from the parent ship 130. The line 125 is attached to the parent ship 130 at one end 126, and has a free end 127. According to this embodiment, the parent ship 130 may be any vessel that is capable of towing the line 125. As opposed to the system 100 that includes a towing station 120, the system 400 does not include a towing station, and the water vessel 110 captures the line 125 directly as the line 125 extends from the parent ship 130. The water vessel 110 is equipped with an actuated catch 200, as illustrated above in FIGS. 2A-2E. The line 125 is made from a material that allows it to float on the water. According to an embodiment, the free end 127 may be attached to a floatation device, such as a miniature buoy to assist the line's ability to float on the water.

The line capturing system 400 operates in a similar manner to the system 100 outlined above. Thus, when the water vessel 110 is directed over the line 125, in direction Y (shown in FIG. 4), the actuated catch 200 captures the line 125. According to this embodiment, the parent ship 130 and line 125 are initially at rest when the water vessel 110 drives over the line 125. The water vessel 110 then comes to a stop. During the forward, then stopping motion of the water vessel 110, the line 125 follows the path, with respect to the bow 111, shown in FIG. 3A. Next, the parent ship 130 moves from forward from the initial stopped state. The combination of the forward motion of the ship 130, and the shape of the how 111 causes the line 125 to move back to the actuated catch 200 in the path shown in FIG. 313, wherein the line 125 is captured by the actuated catch 200, as shown in FIG. 313.

It should be noted that the actuated catch 200 is in the retrieval and holding mode when capturing and securely holding the line 125. If the line 125 is to be released, the actuated catch 200 is switched to the release mode, in which the hook assembly rotates down to the release position show in FIG. 2A. The switching from release mode to retrieval and holding mode, and vice versa may be performed by an operator. Apart from the switching from one mode to another, in system 100 (shown in FIG. 1) the actuated catch 200 operates automatically based on the acceleration and subsequent throttling down of the water vessel 110, without the requirement of sensors. In system 400 (shown in FIG. 4) the actuated catch 200 operates automatically based on the acceleration and subsequent stopping of the water vessel 110, followed by the subsequent forward motion of the parent ship 130 which was initially stationary, also without the requirement of sensors.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A water vessel for releasably capturing a substantially taut line, the water vessel comprising:

a hull body having a bow;

an actuated catch attached at the bow of a water vessel, the actuated catch positioned for capturing the line, the actuated catch comprising:

a pivotable hook assembly having a substantially V-shaped receiving portion for receiving the line therein, the pivotable hook assembly comprising:

a substantially L-shaped arm including a triangular claw; and a protective shield attached to the substantially L-shaped arm at a pivot point, wherein the pivotable hook assembly is pivotable about said pivot point, and wherein the protective shield and the triangular claw are angled to form the substantially V-shaped receiving portion;

an actuator for pivoting the pivotable hook assembly about the pivot point, from a release position to a retrieval and holding position; and a spring biased retaining catch having a holding tip for maintaining the line within the receiving portion when the pivotable hook assembly is in the retrieval and holding position, and wherein the protective shield covers the holding tip when the pivotable hook assembly is in the release position.

2. The water vessel for releasably capturing a line of claim 1, wherein the actuated catch further comprises a casing for housing the pivotable hook, the actuator, and the spring biased retaining catch, wherein the casing comprises:

first and second plates, each of the first and second plates having a substantially trapezoidal shape with a top edge portion, a middle edge portion, and a bottom edge portion, wherein the pivotable hook assembly and the spring biased retaining catch protrude beyond the bottom edge portion of the first and second plates, and wherein the middle edge portion and the bottom edge portion are angled so that when the actuated catch contacts the line, the line slides down the middle edge portion and the bottom edge portion onto a bow portion below the level of the actuated catch.

3. The water vessel for releasably capturing a line of claim 2, wherein the actuated catch further comprises a cam lock for locking the pivotable hook assembly in the retrieval and holding position.

4. The water vessel for releasably capturing a line of claim 3, wherein in the release position both the triangular claw and the protective shield extend beyond the first and second plates, external to the casing, with the protective shield covering the retaining catch, and wherein in the retrieval and holding position, the protective shield is withdrawn into the housing.

5. The water vessel for releasably capturing a line of claim 4, wherein the bow of the water vessel includes a bow eye, and wherein the actuated catch is attached to the bow eye, the actuated catch further including a catch bow eye at the middle edge portion of the casing.

6. A system for the open water securing and towing a water vessel, the system comprising:

a parent ship;

a towing station attached to the parent ship via a first tow line, wherein the towing station comprises:

a first arm;

a second arm, wherein the first and second arms define a substantially U-shaped opening for receiving a water vessel in a receiving direction; and a line attached to each of the first and second arms, so that the line is substantially taut and is substantially perpendicular to said receiving direction;

a water vessel for releasably capturing the substantially taut line, the water vessel comprising:

a hull body having a bow;

an actuated catch attached at the bow of a water vessel, the actuated catch positioned for capturing the line, the actuated catch comprising:

a pivotable hook assembly having a substantially V-shaped receiving portion for receiving the line therein, the pivotable hook assembly comprising:

a substantially L-shaped arm including a triangular claw; and a protective shield attached to the substantially U-shaped arm at a pivot point, wherein the pivotable hook assembly is pivotable about said pivot point, and wherein the protective shield and the triangular claw are angled to form the substantially V-shaped receiving portion;

an actuator for pivoting the pivotable hook assembly about the pivot point, from a release position to a retrieval and holding position; and a spring biased retaining catch having a holding tip for maintaining the line within the receiving portion when the pivotable hook assembly is in the retrieval and holding position, and wherein the protective shield covers the holding tip when the pivotable hook assembly is in the release position.

7. The system of claim 6, wherein the actuated catch on the water vessel further comprises a casing for housing the pivotable hook, the actuator, and the spring biased retaining catch, wherein the casing comprises:

first and second plates, each of the first and second plates having a substantially trapezoidal shape with a top edge portion, a middle edge portion, and a bottom edge portion, wherein the pivotable hook assembly and the spring biased retaining catch protrude beyond the bottom edge portion of the first and second plates, and wherein the middle edge portion and the bottom edge portion are angled so that when the actuated catch contacts the line, the line slides down the middle edge portion and the bottom edge portion onto a bow portion below the level of the actuated catch.

8. The system of claim 7, wherein the actuated catch further comprises a cam lock for locking the pivotable hook assembly in the retrieval and holding position.

9. The system of claim 8, wherein in the release position both the triangular claw and the protective shield extend beyond the first and second plates, external to the casing, with the protective shield covering the retaining catch, and wherein in the retrieval and holding position, the protective shield is withdrawn into the housing.

10. The system of claim 9, wherein the bow of the water vessel includes a bow eye, and wherein the actuated catch is attached to the bow eye, the actuated catch further including a catch bow eye at the middle edge portion of the casing.

11. The system of claim 10, wherein the pivotable hook assembly is locked in said retrieval and holding position, with the line held within the receiving portion substantially V-shaped receiving portion of the pivotable hook and the retaining catch, and wherein the parent ship is travelling and pulling the towing station and the attached water vessel.

12. A method of releasably capturing a line comprising:

providing a parent ship;

providing a towing station connected to the parent ship via a first tow line, the towing station comprising:

a first arm;

a second arm, wherein the first and second arms define a substantially U-shaped opening for receiving a water vessel in a receiving direction; and a line attached to each of the first and second arms, so that the line is substantially taut and is substantially perpendicular to said receiving direction;

providing a water vessel on open water, the water vessel comprising:

a hull body having a bow;

an actuated catch attached at the bow of a water vessel, the actuated catch positioned for capturing the line, the actuated catch comprising:

a pivotable hook assembly having a substantially V-shaped receiving portion for receiving the line therein, the pivotable hook assembly comprising:

a substantially L-shaped arm including a triangular claw; and a protective shield attached to the substantially L-shaped arm at a pivot point, wherein the pivotable hook assembly is pivotable about said pivot point, and wherein the protective shield and the triangular claw are angled to form the substantially V-shaped receiving portion;

an actuator for pivoting the pivotable hook assembly about the pivot point, from a release position to a retrieval and holding position; and a spring biased retaining catch having a holding tip for maintaining the line within the receiving portion when the pivotable hook assembly is in the retrieval and holding position, and wherein the protective shield covers the holding tip when the pivotable hook assembly is in the release position;

the method further comprising:

propelling the parent ship thereby towing the towing station therebehind;

setting the hook assembly of water vessel in a retrieval mode;

driving the water vessel at a greater speed than that of the parent ship so that the water vessel enters the substantially U-shaped opening of the towing station and driving the water vessel over the substantially taut line so that said substantially taut line contacts and slides over the actuated catch onto a bow surface below the actuated catch; and throttling down the water vessel to stop or reduce the water velocity to a speed less than that of the parent ship so that the substantially taut line travels in a reverse direction with respect to the water vessel, the substantially taut line riding up the bow onto the actuated catch, wherein the substantially taut line presses down on the spring biased retaining catch and enters into the substantially V-shaped receiving portion wherein the line is held by the hook assembly and the retaining catch so that the water vessel is securely attached to the towing station and is towed behind the parent ship.

13. The method of claim 12, further comprising setting the hook assembly of water vessel in a release mode, thereby releasing the line from within the receiving portion of the hook assembly and releasing the water vessel from the towing station.

* * * * *